US007367251B2

(12) United States Patent
Titz

(10) Patent No.: US 7,367,251 B2
(45) Date of Patent: May 6, 2008

(54) FORMAT CHANGE IN A CORRUGATING PLANT

(75) Inventor: Felix Titz, Weiherhammer (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 252 days.

(21) Appl. No.: 11/258,144

(22) Filed: Oct. 26, 2005

(65) Prior Publication Data

US 2006/0086217 A1 Apr. 27, 2006

(30) Foreign Application Priority Data

Oct. 26, 2004 (EP) ..... 04025396

(51) Int. Cl.
*B26D 3/00* (2006.01)

(52) U.S. Cl. ..... 83/13; 83/39; 83/44; 83/45; 83/304; 83/508.1

(58) Field of Classification Search ..... 83/13, 83/39, 43, 44, 45, 304, 303, 495, 508.1; 493/362, 493/366

See application file for complete search history.

(56) References Cited

U.S. PATENT DOCUMENTS 4,380,943 A * 4/1983 Evans ..... 83/38
4,388,794 A * 6/1983 Focke et al. ..... 53/389.3
5,297,461 A * 3/1994 Hirakawa et al. ..... 83/304
5,393,294 A * 2/1995 Jobst ..... 493/342
6,553,883 B1 * 4/2003 Adami ..... 83/508.1
2003/0000988 A1 1/2003 Rahland et al.

FOREIGN PATENT DOCUMENTS

| | | |
|---|---|---|
| DE | 4305158 | 8/1994 |
| DE | 10131833 A1 | 1/2003 |
| EP | 0468374 A2 | 1/1992 |
| EP | 0737553 A1 | 10/1996 |
| EP | 0894583 A2 | 2/1999 |
| GB | 2305675 A | 4/1997 |

* cited by examiner

*Primary Examiner*—Boyer D. Ashley
*Assistant Examiner*—Omar Flores-Sánchez
(74) *Attorney, Agent, or Firm*—Browdy and Neimark, P.L.L.C.

(57) ABSTRACT

A method of implementing a change of format in a system for cutting sheets of corrugated board comprises the application of at least three first longitudinal cuts by a first group of longitudinal-cutter tool and at least three second longitudinal cuts by a second group of longitudinal-cutter tools. All the three longitudinal cuts overlap one another in the conveying direction. In this way, the corrugated board can be exploited more efficiently in the area of format change.

12 Claims, 5 Drawing Sheets

FORMAT CHANGE IN A CORRUGATING PLANT

BACKGROUND OF THE INVENTION

1. Field of the Invention

The invention relates to a method of format change of a system for cutting a continuous web of corrugated board, which is conveyed in a conveying direction and has two lateral margins, into several continuous sectional webs of corrugated board, having a first and a second group of longitudinal-cutter tools, the method comprising the following steps: producing two first external longitudinal cuts and an intermediate first internal longitudinal cut in a web of corrugated board by a first group of longitudinal-cutter tools; disengaging at least a part of the first group of longitudinal-cutter tools from the web of corrugated board; engaging at least a part of the second group of longitudinal-cutter tools with the web of corrugated board; producing two second external longitudinal cuts and an intermediate second internal longitudinal cut in the web of corrugated board by the second group of longitudinal-cutter tools; producing an internal connecting cut which connects the first internal longitudinal cut and the second internal longitudinal cut and extends crosswise of the conveying direction; producing two external connecting cuts which extend crosswise of the conveying direction and respectively connect a first external longitudinal cut and a second external longitudinal cut.

2. Background Art

EP 0 894 583 B1 teaches a method of format changeover in a slitter/scorer machine in a corrugating plant. Provision is made for a first series of slitting tools and a second series of slitting tools, each consisting of a row of rotating, individually disengageable knives. For format changeover, all the knives of the first series of slitting tools disengage from the web of corrugated board with the exception of a single knife. Only the knife that remains engaged with the web of corrugated board makes a longitudinal cut further into an area of format change. Then this knife disengages too. Simultaneously a single knife of the second series of slitting tools moves into an active position so that the cut that is produced and the cut that extends into the area of format change overlap at their respective ends in the conveying direction. Sequentially, all the other knives of the second series of slitting tools engage with the web of corrugated board. Subsequently, the two longitudinal cuts that project into the area of format changeover are connected with one another by a crosscut that extends vertically of the conveying direction so that two continuous sectional webs of corrugated board originate which then move via a switch on to two different levels. Drawbacks of the known method of format changeover reside in that the entire corrugated board of the area of format change cannot be exploited in the subsequent job of cutting the sheets of corrugated board to size, thus being scrap. Given high conveying rates of for instance 300 m/min, format changeover areas of considerable length may result. Removing the area of format change from the web of corrugated board poses an additional problem. In dependence on the type of format changeover, the one-piece reject frequently has a width of more than half the width of the web of corrugated board. However, webs of corrugated board of inferior width are stacked subsequently so that the rejects frequently lead to inaccuracies in the job of stacking the sheets of corrugated board.

SUMMARY OF THE INVENTION

It is an object of the invention to improve the above method of format change in such a way that the described drawbacks are reduced. In a method of the type mentioned at the outset, the object is attained by the features wherein the longitudinal cuts are made such that the first external longitudinal cuts and the second external longitudinal cuts lap over one another in pairs in the conveying direction and such that the first internal longitudinal cut and the second internal longitudinal cut lap over one another in the conveying direction; and wherein the external connecting cuts are applied such that they end before the respectively adjacent margin. The gist of the invention resides in producing at least three respective longitudinal slits by a first and a second group of longitudinal-cutter tools, all of the slits lapping over one another and their ends being connected with one another in pairs by connecting cuts so that four continuous sectional webs originate, namely two continuous marginal strips and two continuous sectional webs of corrugated board that are going to be subsequently treated. In this way, the length of the area of format change is strongly reduced in the conveying direction so that on the whole, the web of corrugated board can be exploited more efficiently. Moreover, the rejects have an inferior width, which considerably reduces any problems of stacking the sheets of corrugated board.

Additional features and details of the invention will become apparent from the ensuing description of an exemplary embodiment, taken in conjunction with the drawing.

DESCRIPTION OF A PREFERRED EMBODIMENT

Figure 1:
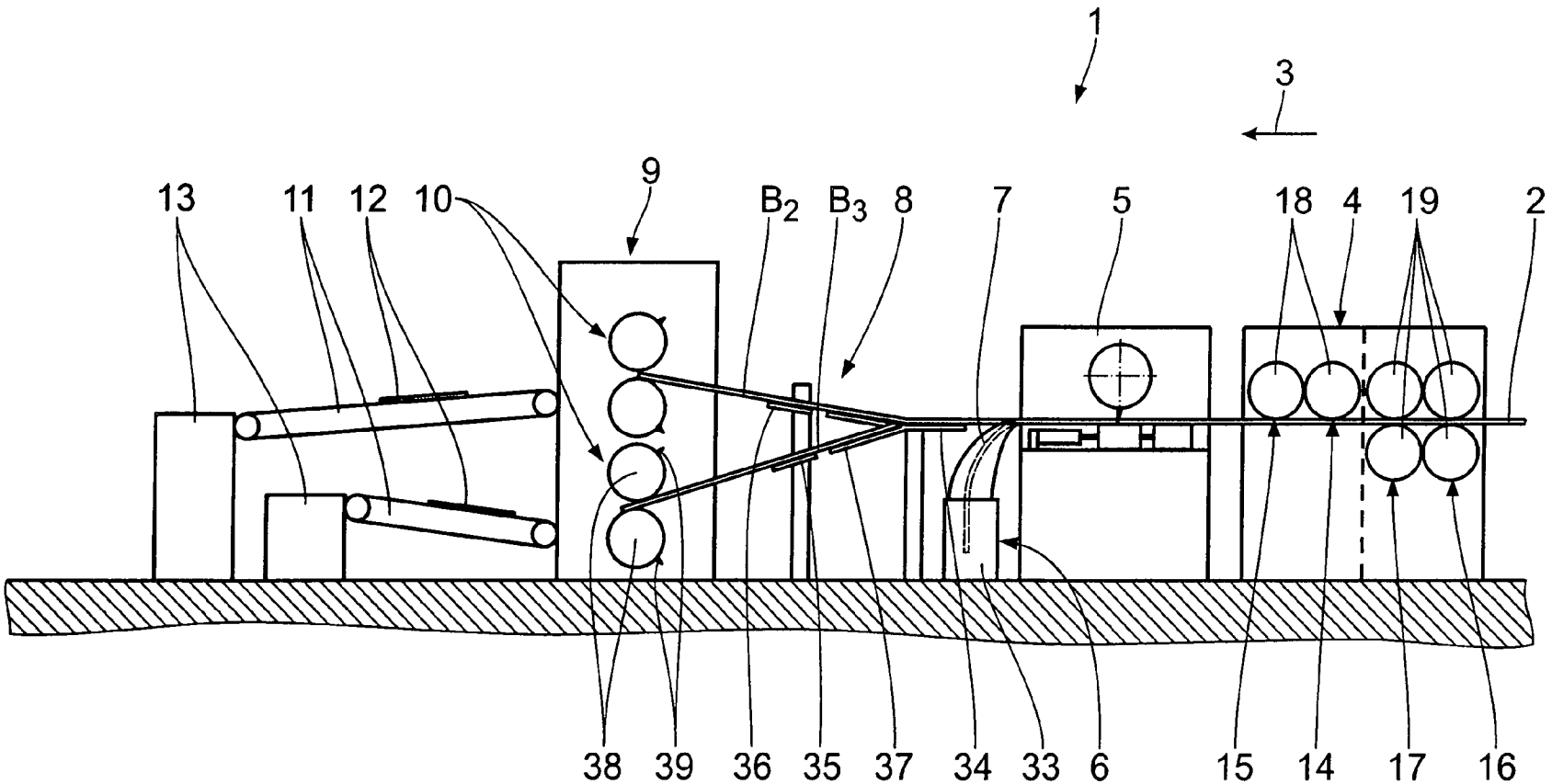
FIG. 1 is a diagrammatic side view of a corrugating plant.

A corrugating plant 1 comprises a customary corrugating machine for the production of webs of corrugated board, known for example from U.S. Pat. No. 5,632,850, GB 2 305 675 A or DE 43 05 158 A1, which reference is made to for further details. The corrugating machine is located to the right of FIG. 1 and not shown.

In a conveying direction 3, the corrugating plant 1 successively comprises a longitudinal-cutter/scorer unit 4 and a cross cutter 5 downstream thereof. It is also possible to dispose the cross cutter 5 upstream of the longitudinal cutter/scorer unit 4. Downstream of the cross cutter 5, a marginal-strip-discharge unit 6 is disposed in the vicinity of both margins of the web of corrugated board 2, discharging the marginal strips 7. Downstream thereof, provision is made for a switch 8 for dividing the web of corrugated board 2 into two levels. A cross-cutter unit 9 is disposed downstream of the switch 8, having two sectional cross cutters 10 one on top of the other. Directly downstream of the cross-cutter unit 9, provision is made for one conveyor belt 11 per sectional cross cutter 10, delivering to a depository stack 13 sheets of corrugated board 12 that have been slit to size.

The longitudinal-cutter/scorer unit 4 comprises a first longitudinal-cutter unit 14 as well as a second downstream longitudinal-cutter unit 15. A first scorer unit 16 and a second scorer unit 17 are disposed upstream of the longitudinal-cutter units 14, 15. The longitudinal-cutter units 14 and 15 comprise tool beds which are provided with rotating knives 18 that are mounted on tool holders and can be shifted individually crosswise of the conveying direction 3. The knives 18 are able individually to engage with the web of corrugated board 2, cooperating with rotating brush rolls (not shown) which are disposed on the other side of the web of corrugated board 2 when the knives 18 are sunk into the web of corrugated board 2. The scorer units 16 and 17 each comprise two tool beds which are disposed one on top of the other substantially in mirror symmetry to the web of corrugated board 2. The pivotable tool beds are provided with scoring tools 19 which are disposed on tool holders and individually displaceable crosswise of the conveying direction 3. The scoring tools 19 are able to engage individually with the web of corrugated board 2. As regards the detailed design of the longitudinal-cutter/scorer unit 4, reference is made to U.S. Pat. No. 6,071,222 and DE 101 31 833 A.

Figure 2:
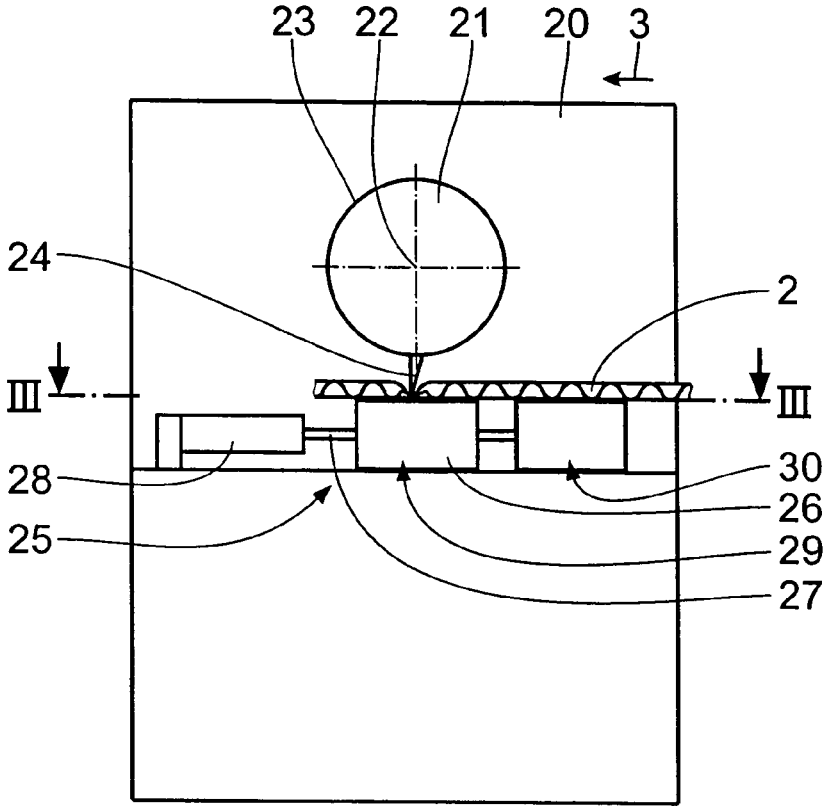
FIG. 2 is a diagrammatic side view of a cross-cutter unit according to FIG. 1.
Figure 3:
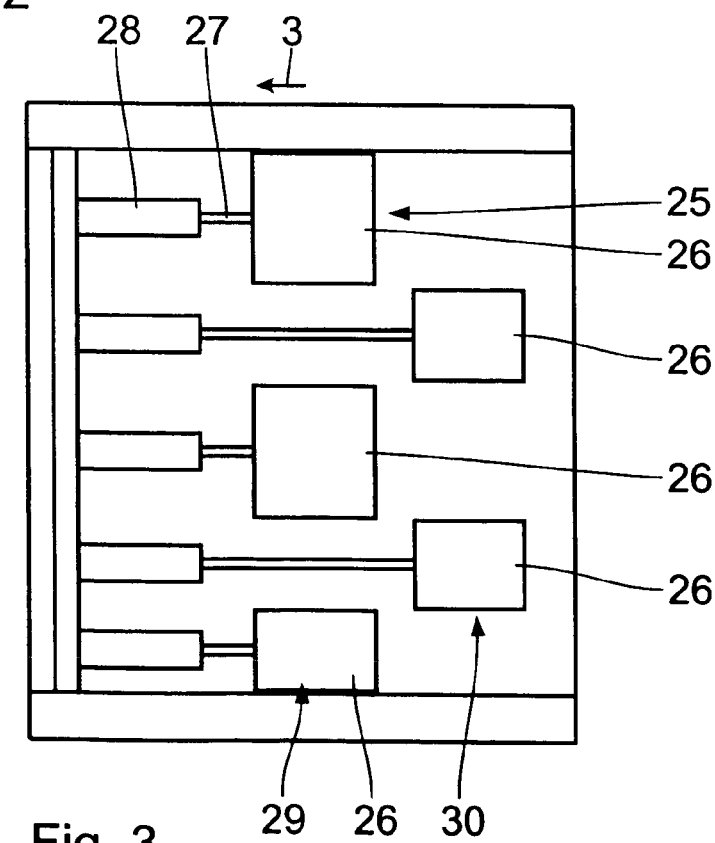
FIG. 3 is a sectional view of the cross-cutter unit according to FIG. 2 on the line III-III.

FIGS. 2 and 3 show details of the cross cutter 5 of FIG. 1. The cross cutter 5 comprises a casing 20, in which a roll 21 is lodged for rotation about and axis of rotation 20 which is perpendicular to the conveying direction 3. The casing 20 is designed for the web of corrugated board 2 to be transportable through the cross cutter 5 directly below the roll 21. A knife 24 is mounted on the surface area 23 of the roll 21, extending radially outwards and vertically of the conveying direction 3 throughout the width of the web of corrugated board 2. Underneath the web of corrugated board 2, several support units 25 are disposed side by side vertically of the conveying direction 3. Each support unit 25 comprises a cutting support 26 which is also termed anvil and fixed to a piston rod 27 of a hydraulic cylinder 28. The cutting support 26 is movable in the conveying direction 3 by the hydraulic cylinder 28. The cutting supports 26 may all have an identical width or vary in width vertically of the conveying direction 3. The number of the supports 26 conforms to the accuracy desired for adjustment of the lengths of the cross-cuts to be made. As a rule, the number of supports 26 exceeds the number seen in FIG. 3.

By means of the associated hydraulic cylinder 28, each cutting support 26 can be moved from a first position into a second position and vice versa. In the first position—the position of cutting 29—the support 26 is located directly underneath the roll 21. The vertical distance of the roll 21 from the cutting support 26 is selected such that the knife 24, upon rotation of the roll 21, nearly touches the cutting support 26, but completely severs the web of corrugated board 2 located there-between. The vertical adjustment may also be selected for the knife 24 to touch the cutting support 26. In the second position—the non-cutting position 30—the piston rod 27 of the hydraulic cylinder 28 is fully extracted so that the cutting support 26 is located upstream thereof in the conveying direction 3. The marginal-strip-discharge unit 6 is comprised of delivery tables which are disposed in the vicinity of the margins 31, 32 of the web of corrugated board 2, mouthing into two downstream collecting containers 33 that are disposed there-below.

The switch 8 comprises a feed table 34 for supply of the web of corrugated board 2 and two delivery tables 35, 36, one on top of the other, for delivery of the web of corrugated board 2 on two levels. For improved transfer of the web of corrugated board 2 from the feed table 34 to the delivery tables 35, 36, provision is made for several switch elements 37 which are disposed side by side on the feed table 34 and are able to pivot in relation to the delivery tables 36 into corresponding angular positions. Reference is made to DE 103 54 671.5 for a detailed description of the fundamental design of the switch 8.

The cross-cutter unit comprises two sectional cross cutters 10 which are disposed one on top of the other. Each sectional cross cutter 10 comprises two rotating cross-cutter rolls 38 which are disposed one on top of the other, extending vertically of the conveying direction 3; each roll 38 has a radially outward cross-cutter knife 39 for sizing the sheets of corrugated board, completely and transversely slitting a web of corrugated board that passes there-through.

The following is a description of the regular job of cutting to size sheets of corrugated board 12, i.e. without any change of format. The job of scoring fulfilled by the scorer units 16 and 17 will not be explained. For the production of longitudinal cuts, the knives 18 of for example the first longitudinal-cutter unit 14 are in engagement with the web of corrugated board 2. The number of knives 18 and, consequently, the number of the longitudinal cuts produced depends on the respective order i.e., on the size to which to cut the web of corrugated board. Two external longitudinal cuts $L_{11}$ and $L_{31}$ sever the two external marginal strips 7 which are also denoted by $B_1$ and $B_4$. The marginal strips 7 are being discharged laterally by the marginal-strip-discharge unit 6; they do not pass via the switch 8. The other longitudinal cuts $L_{41}$, $L_{51}$, $L_{21}$ and $L_{61}$ seen in FIG. 4 define longitudinal strips $S_{11}$, $S_{21}$, $S_{31}$, $S_{41}$, $S_{51}$, with the strips $S_{11}$, $S_{21}$ and $S_{31}$ being allocated to the continuous web $B_2$ and the strips $S_{41}$ and $S_{51}$ to the continuous web $B_3$. The webs $B_2$ and $B_3$ run through the cross cutter 5 without it becoming active. In the switch 8, the continuous web $B_2$ is led on to the top delivery table 36 and the web $B_3$ on to the bottom delivery table 35. The sectional cross cutters 10 divide the webs $B_2$ and $B_3$ into individual sheets of corrugated board 12 by means of cross-cuts K. Then the sheets of corrugated board 12 are being delivered in imbricated form by the conveyor belt 11 and piled on the depository stack 13. Producing two continuous sectional webs of corrugated board $B_2$, $B_3$ is accompanied with the advantage that two different exploitable lengths $H_{21}$ and $H_{31}$ can be employed i.e., the distance between adjacent crosscuts K, because the sectional webs of corrugated board $B_2$, $B_3$ pass through different sectional cross cutters 10. The width of the strips $S_{11}$, $S_{21}$, $S_{31}$, $S_{41}$, $S_{51}$ crosswise of the conveying direction 3 is freely adjustable i.e., not all the strips within a sectional web of corrugated board $B_2$ or $B_3$ must have the same width. Apart from the external longitudinal cuts $L_{11}$ and $L_{31}$ which sever the marginal strips 7, special importance must be attributed to the internal longitudinal cut $L_{21}$ which divides the sectional webs of corrugated board $B_2$ and $B_3$.

Figure 4:
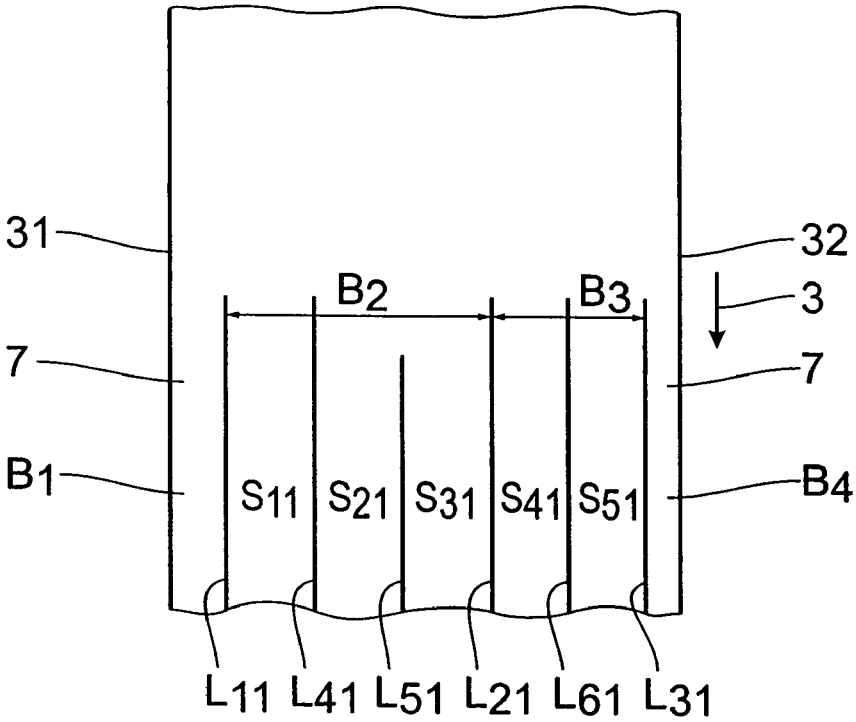
FIG. 4 is a plan view of a web of corrugated board upon format changeover after a first step.
Figure 5:
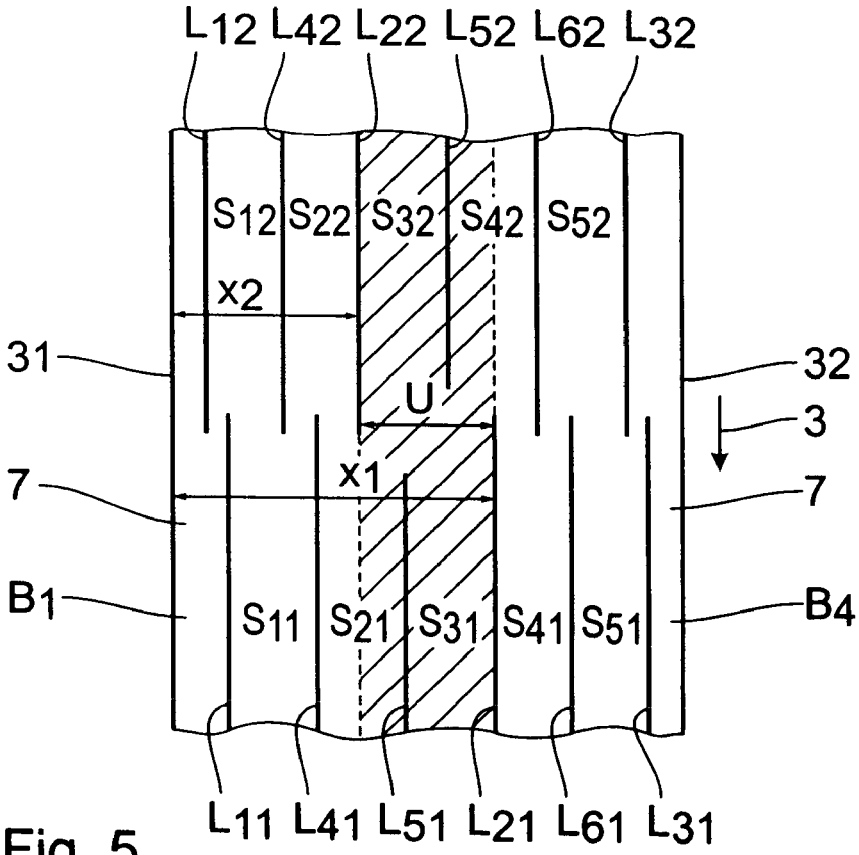
FIG. 5 is an illustration according to FIG. 4 after a second step.

The following is a description of the sequence of format changeover, taken in conjunction with the succession of FIGS. 4 to 8*b*. The web of corrugated board 2 is assumed to be slit, prior to the change of format, by knives 18 of the first longitudinal cutter unit 14, which is illustrated in FIG. 4. If format changeover is intended to take place, then the positions of the knives 18 of the second longitudinal-cutter unit 15 are being calculated first and the knives 18 are being moved into the corresponding transverse position. In this case it is important which knife 18 will make the second internal longitudinal cut $L_{22}$ that divides the sectional longitudinal webs $B_2$, $B_3$. The distance of the first internal longitudinal cut $L_{21}$ from the margin 31 is denoted by $x_1$. The distance of the second internal longitudinal cut $L_{22}$ is denoted by $x_2$. As a rule, $x_1 \neq x_2$ applies upon format changeover i.e., the width of the continuous sectional webs of corrugated board $B_2$, $B_3$ changes during a change of format. Of course this is not forcibly so. It is just as well possible that the width of the webs $B_2$, $B_3$ remains unchanged and that only the position of the longitudinal slits within the sectional webs changes. An area of overlap U results from the difference between $x_1$ and $x_2$, extending from the right edge of $x_2$ to the right edge of $x_1$ as seen in FIG. 5. On one side the area of overlap U is defined by a line which is located on the first internal longitudinal cut $L_{21}$ and on the other side by a line which is located on the second internal longitudinal cut $L_{22}$. During the intended change of format, the continuous sectional webs of corrugated board $B_2$, $B_3$ overlap in the lap area U vertically of the conveying direction 3. When the lap area U has been determined, a check is made as to whether one of the first longitudinal cuts $L_{11}$, $L_{21}$, $L_{31}$, $L_{41}$, $L_{51}$, $L_{61}$ is located in the lap area U i.e., whether it has a distance from the margin 31 that ranges between $x_2$ and $x_1$. In the case seen in FIG. 5, this applies to the longitudinal cut $L_{51}$. For format changeover, the knife or, optionally, the knives which are located in the area of overlap U disengage from the web of corrugated board 2 shortly before the other knives of the longitudinal-cutter unit 14. Then all the other knives which produce the longitudinal cuts $L_{11}$, $L_{41}$, $L_{21}$, $L_{61}$ and $L_{31}$ disengage simultaneously so that these slits are longer than the cut $L_{51}$.

With the exception of the knife or knives which are located in the area of overlap U, all the knives of the second longitudinal-cutter unit 15 are being moved into engagement with the web of corrugated board 2 at such intervals that the second longitudinal cuts produced, $L_{12}$, $L_{42}$, $L_{22}$, $L_{62}$ and $L_{32}$, lap over the ends of the first longitudinal cuts $L_{11}$, $L_{41}$, $L_{21}$, $L_{61}$, $L_{31}$ in the conveying direction 3. In other words, as seen along the web of corrugated board, the second longitudinal slits start before the first longitudinal slits end. Only the knife 18 or the knives 18 of the second longitudinal-cutter unit 15 which are located in the lap area U are being engaged belatedly so that the produced slit or slits do not lap over the first slits. In FIG. 5, this is the cut $L_{52}$. This means that the start of the longitudinal cut $L_{52}$ does not lap over the ends of the longitudinal cuts $L_{11}$, $L_{41}$, $L_{21}$, $L_{61}$ and $L_{31}$ along the web of corrugated board. The same applies to the longitudinal cut $L_{51}$ which does not lap over the start of the longitudinal cuts $L_{12}$, $L_{42}$, $L_{22}$, $L_{62}$ and $L_{32}$ along the web of corrugated board. This is the second step illustrated in FIG. 5. The longitudinal cuts overlap one another in the conveying direction 3 by a length of at least one meter, in particular at least 50 cm, in particular at least 20 cm, in particular at least 5 cm, in particular at least 1 cm, with a lap of 20 cm being especially favorable.

Figure 6:
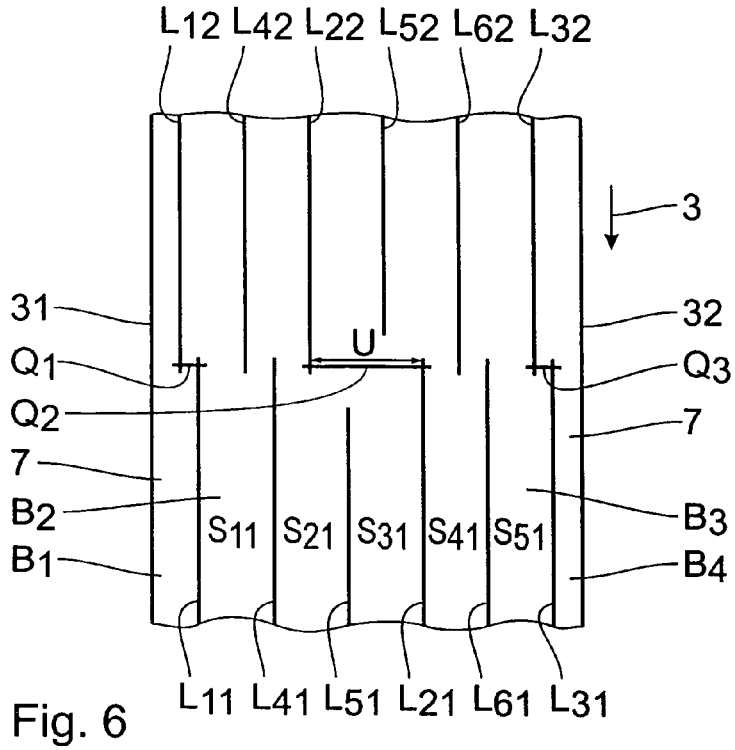
FIG. 6 is an illustration according to FIG. 4 after a third step.

The third step is illustrated in FIG. 6. The cross cutter 5 implements three connecting cuts $Q_1$, $Q_2$ and $Q_3$ of predetermined length and position. The position and length of the connecting cuts is being adjusted by which cutting supports 26 are in the position of cutting 29. Longer cuts can be produced by several cutting supports 26 being disposed side by side in the cutting position 29. In FIG. 6, the connecting cuts $Q_1$, $Q_2$ and $Q_3$ are level i.e., on a line. Fundamentally it is possible to arrange the connecting cuts in varying positions lengthwise i.e., displaced from one another in the conveying direction 3. The connecting cut $Q_1$ interconnects the cuts $L_{11}$ and $L_{12}$ so that the continuous marginal strip $B_1$ is being detached from rest of the web of corrugated board. It is important that the connecting cut $Q_1$ does not extend as far as to the margin 31 so that the marginal strip $B_1$ is kept continuous and will not be cut through. If the marginal strip is being divided, problems may arise in the discharge of the marginal strips. The same is true for the connecting cut $Q_3$ which interconnects the cuts $L_{31}$ and $L_{32}$ in the vicinity of the margin 32. The connecting cut $Q_3$ does not extend as far as to the directly adjacent margin 32 so that the marginal strip $B_4$ is kept continuous upon format changeover. The connecting cut $Q_2$ connects the first internal longitudinal cut $L_{21}$ to the second internal longitudinal cut $L_{22}$, whereby the continuous sectional webs of corrugated board $B_2$ and $B_3$ are being separated from one another. With the longitudinal cuts $L_{51}$ and $L_{52}$ that are located in the area of overlap U ending earlier or commencing later, the sectional webs of corrugated board $B_2$, $B_3$ are continuous even after the change of format i.e., all the strips of a respective sectional web of corrugated board prior to the format changeover and the strips of the respective web of corrugated board after the format changeover are united in one piece. The connecting cuts $Q_1$, $Q_2$ and $Q_3$ are perpendicular to the conveying direction 3. As seen in FIG. 6, crosswise of the conveying direction, they project only slightly from the longitudinal slits that must be connected, for example $L_{11}$ and $L_{12}$, ensuring that the longitudinal cuts are indeed connected to one another. The more accurately the longitudinal cutters and the cross cutters are able to be positioned, the more the respective overlap can be reduced, until being near zero. Of course it is possible to apply the connecting cuts $Q_1$, $Q_2$ and $Q_3$ prior to the longitudinal cuts of the longitudinal-cutter units 14, 15. In this case, the connecting cuts $Q_1$, $Q_2$ and $Q_3$ will first be applied in pre-determined positions, after which the first and second longitudinal cuts will be made. Also, the terms of the first longitudinal-cutter unit 14 disengaging and of the second longitudinal-cutter unit 15 engaging mean that the longitudinal slits produced just precisely overlap. Depending on the geometry and on the triggering of the knives in the longitudinal-cutter units, it may be necessary to trigger them at an earlier or later time. It depends on the geometric sequence of the produced longitudinal cuts.

Figure 7A:
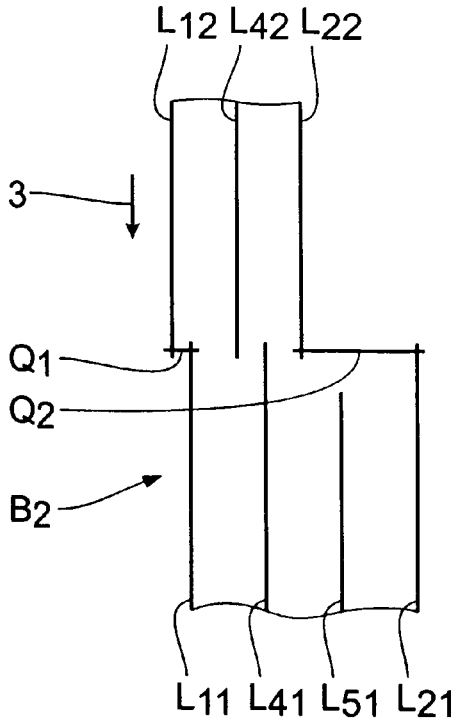
FIGS. 7*a* and 7*b* are illustrations according to FIG. 4 of the sectional webs, delivered upwards and downwards, after a fourth step.
Figure 7B:
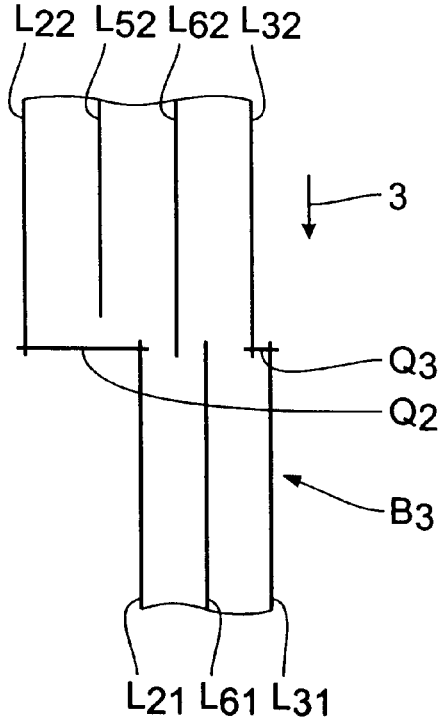

FIGS. 7*a* and 7*b* show the fourth step of treatment. After discharge of the marginal strips $B_1$, $B_4$, the two continuous sectional webs of corrugated board $B_2$, $B_3$ are being delivered on two levels in the switch 8. The web $B_2$ that is delivered upwards is seen in FIG. 7*a*. The web $B_3$ that is delivered downwards is seen in FIG. 7*b*. It becomes obvious once again that the sectional webs of corrugated board $B_2$, $B_3$ are continuous. The continuous webs of corrugated board $B_2$, $B_3$ are being fed to the sectional cross cutters 10.

Figure 8A:
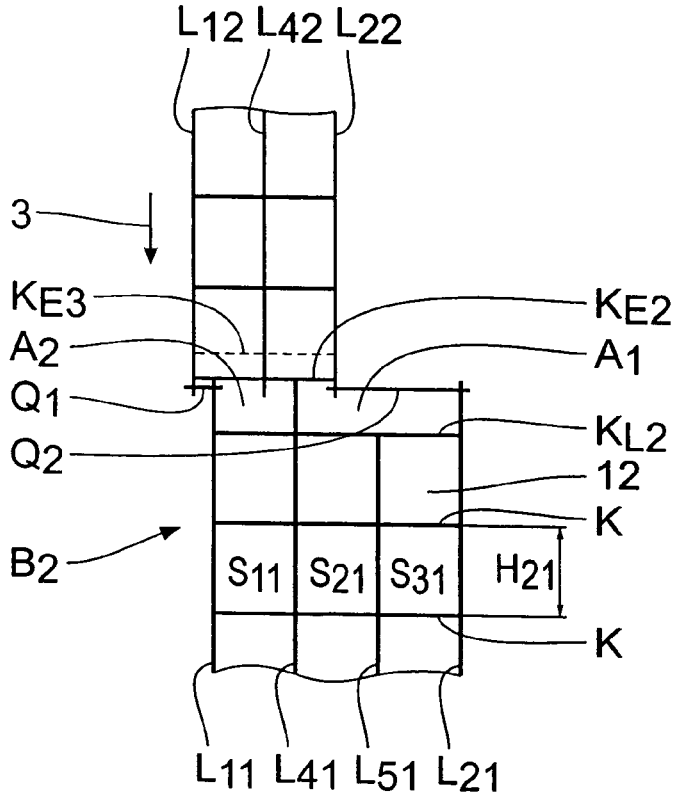
FIGS. 8*a* and 8*b* are illustrations according to FIGS. 7*a* and 7*b* after a fifth step.
Figure 8B:
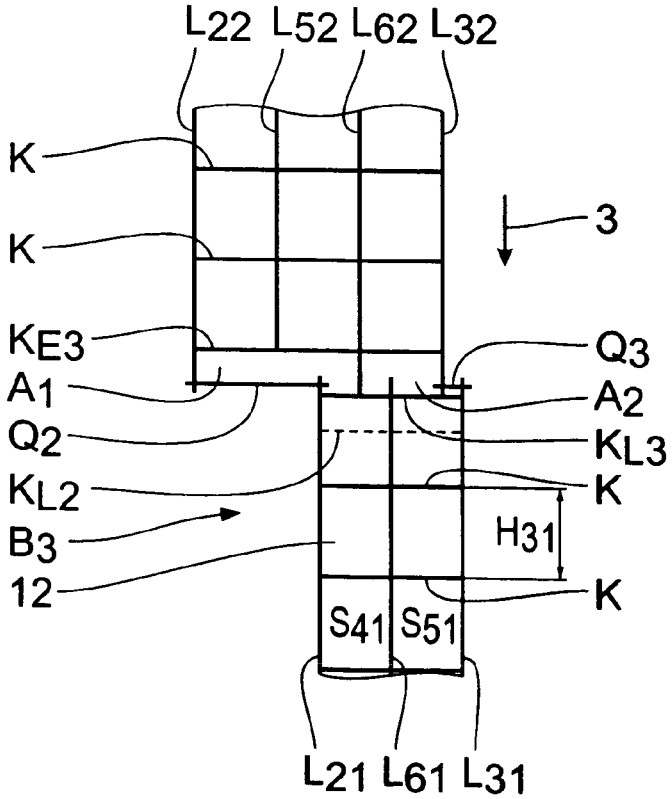

That is when the fifth and last step starts, which is illustrated in FIGS. 8*a* and 8*b*. The sectional cross cutters 10 provide the sectional webs of corrugated board $B_2$, $B_3$ with cross-cuts K over the entire width thereof, with the exploitable length i.e., the distance of neighbouring crosscuts K, being freely adjustable. In the following, the job of cutting the web $B_3$ to size will be described, taken in conjunction with FIG. 8*b*. For optimal exploitation of the web $B_3$ in the vicinity of the connecting cuts $Q_1$, $Q_2$ and $Q_3$, the exploitable length, i.e. the distance of adjacent crosscuts K, is being set for location of the last crosscut $K_{L3}$ before the connecting cuts $Q_2$ and $Q_3$ so that it directly adjoins the start of the second longitudinal cuts, in this case $L_{62}$ and $L_{32}$. In this way the entire corrugated board can be exploited as far as right into the area of format changeover. In EP 0 894 583 B1, the web of corrugated board, throughout its width, is not exploitable as soon as all the longitudinal-cutter tools, with the exception of one, have disengaged, which is not true for the solution according to the invention. In the web $B_3$, the corrugated board is exploitable as far to the start of the second longitudinal cuts $L_{62}$, $L_{32}$. The gain of corrugated board as opposed to EP 0 894 583 B1 becomes obvious by prolongation into the web $B_3$ of the last cross-cut $K_{L2}$ in the web $B_2$, which will be explained below. The entire area between $K_{L2}$ and $K_{L3}$ has been gained, it being emphasized once again that, due to the high velocity of the web of corrugated board, the area of format changeover may have a considerable length. With there being no need, during a change of format, to engage a knife belatedly because there was none in the area of overlap U, now use can be made of the entire corrugated board after the end of the first longitudinal cuts $L_{21}$, $L_{61}$ and $L_{31}$. This means that, with the first cross-cut $K_{E3}$ after the connecting cuts $Q_2$, $Q_3$ being made right there, the entire board beyond the ends of the first longitudinal slits will exploitable. With it being necessary, as in the present case, belatedly to engage the knife for the longitudinal cut $L_{52}$, then the first cross-cut $K_{E3}$ is being made level with the start of the cut $L_{52}$, which minimizes the area of loss. The sheets denoted by the reference numerals $A_1$ and $A_2$ are scrap. Another advantage of the solution according to the invention becomes visible. Given that only the knife or knives of the area of overlap U engage belatedly and that all the other knives for cutting second longitudinal slits engage simultaneously, the reject in the area of format changeover is being divided, thus becoming narrower. Consequently, it is a lot easier to handle. In the solution according to EP 0 894 583 B1, the rejects $A_1$ and $A_2$ are one piece. As outlined above, in practice the number of longitudinal cuts is higher and there is little probability that there will be any need at all of slits being made in the area of overlap U so that, as compared to EP 0 894 583 B1, stronger exploitation of the board will as a rule be possible in the area of format change and, should there be any rejects, they have already been divided into several pieces. After the cross-cut $K_{E3}$, further cross-cuts K are being made at desired intervals, producing sheets of corrugated board of desired size.

Owing to the constellation given by way of example, the sequence of cuts in the web $B_2$ of FIG. 8*a* is precisely in reverse order. The last cross-cut $K_{L2}$ is being made at the end of a short longitudinal cut $L_{51}$, whereby rejects $A_1$ and $A_2$ originate which are separated from one another. The first crosscut $K_{E2}$ beyond the connecting cuts $Q_1$, $Q_2$ is being made at the end of the longitudinal cuts $L_{11}$ and $L_{41}$. As from there, the web of corrugated board can be exploited to full extent. The gain of web of corrugated board again results from a prolongation of the cut $K_{E3}$ of FIG. 8*b* in FIG. 8*a* i.e., the area between $K_{E2}$ and $K_{E3}$.

Generally, the following applies to the method of format changeover: Fundamentally, all the knives—if possible—of the second longitudinal-cutter unit 15 are being engaged so that the second longitudinal slits produced lap over the ends of the first longitudinal cuts. In particular, at least three pairs of longitudinal cuts, in particular at least four pairs of longitudinal cuts, in particular at least five pairs of longitudinal cuts, overlap in the conveying direction 3. Only when the given format to be slit demands for a longitudinal cut located in the area of overlap U, the corresponding cut, depending on its length, will end before the first longitudinal cuts or after the second longitudinal cuts. Practice has shown that constellations of that kind are comparatively rare, there being a tendency towards trying to place the various orders i.e., sheets of corrugated board that are to be cut, on the web of corrugated board for as small as possible a width of the area of overlap U. The wider the area of overlap U, the more difficult will it be to pass the corresponding web $B_2$ of $B_3$ along the switch 8. If there are no longitudinal cuts in the area of overlap U in case of the first longitudinal cuts and/or the second longitudinal cuts, all longitudinal cuts are made on the corresponding side, all having the same length.

What is claimed is:

1. A method of format change of a system for cutting a continuous web of corrugated board (2), which is conveyed in a conveying direction (3) and has two lateral margins (31, 32), into several continuous sectional webs of corrugated board ($B_1$, $B_2$, $B_3$, $B_4$), having a first and a second group of longitudinal-cutter tools (14, 15), the method comprising the following steps:

a. producing two first external longitudinal cuts ($L_{11}$, $L_{31}$) and an intermediate first internal longitudinal cut ($L_{21}$) in a web of corrugated board (2) by a first group of longitudinal-cutter tools (14);

b. disengaging at least a part of the first group of longitudinal-cutter tools (14) from the web of corrugated board (2);

c. engaging at least a part of the second group of longitudinal-cutter tools (15) with the web of corrugated board (2);

d. producing two second external longitudinal cuts ($L_{12}$, $L_{32}$) and an intermediate second internal longitudinal cut ($L_{22}$) in the web of corrugated board (2) by the second group of longitudinal-cutter tools (15);

e. producing an internal connecting cut ($Q_2$) which connects the first internal longitudinal cut ($L_{21}$) and the second internal longitudinal cut ($L_{22}$) and extends crosswise of the conveying direction (3);

f. producing two external connecting cuts ($Q_1$, $Q_3$) which extend crosswise of the conveying direction (3) and respectively connect a first external longitudinal cut ($L_{11}$, $L_{31}$) and a second external longitudinal cut ($L_{12}$, $L_{32}$);

g. wherein the longitudinal cuts ($L_{11}$, $L_{21}$, $L_{31}$, $L_{12}$, $L_{22}$, $L_{32}$) are made such that the first external longitudinal cuts ($L_{11}$, $L_{31}$) and the second external longitudinal cuts ($L_{12}$, $L_{32}$) lap over one another in pairs in the conveying direction (3) and such that the first internal longitudinal cut ($L_{21}$) and the second internal longitudinal cut ($L_{22}$) lap over one another in the conveying direction (3);

h. wherein the external connecting cuts ($Q_1$, $Q_3$) are applied such that they terminate before the lateral margins (31, 32);

i. wherein an area of overlap (U) is defined as the area between a first line that is located on the first internal longitudinal cut ($L_{21}$), and a second line that is located on the second internal longitudinal cut ($L_{22}$);

j. wherein further first longitudinal cuts ($L_{41}$, $L_{51}$, $L_{61}$) are produced by the first groups of longitudinal-cutter tools (14) and further second longitudinal cuts ($L_{42}$, $L_{52}$, $L_{62}$) are produced by the second group of longitudinal-cutter tools (15);

k. wherein each first longitudinal cut ($L_{51}$), which is located in the area of overlap (U), terminates before the termination of the first external longitudinal cuts ($L_{11}$, $L_{31}$) and the first internal longitudinal cut ($L_{21}$) and each second longitudinal cut ($L_{52}$), which is located in the area of overlap (U), starts after the beginning of the second external longitudinal cuts ($L_{12}$, $L_{32}$) and the second internal longitudinal cut ($L_{22}$) such that longitudinal cuts ($L_{51}$, $L_{52}$), which are located in the area of overlap (U), do not extend as far as to the internal connecting cut ($Q_2$).

2. A method according to claim 1, wherein, in the conveying direction (3), at least four first longitudinal cuts ($L_{11}$, $L_{21}$, $L_{31}$, $L_{41}$, $L_{61}$), which are produced by the first group of longitudinal-cutter tools (14), lap over at least four second longitudinal cuts ($L_{12}$, $L_{22}$, $L_{32}$, $L_{42}$, $L_{62}$), which are produced by the second group of longitudinal-cutter tools (15).

3. A method according to claim 1, wherein, in the conveying direction (3), at least five first longitudinal cuts ($L_{11}$, $L_{21}$, $L_{31}$, $L_{41}$, $L_{61}$), which are produced by the first group of longitudinal-cutter tools (14), lap over at least five second longitudinal cuts ($L_{12}$, $L_{22}$, $L_{32}$, $L_{42}$, $L_{62}$), which are produced by the second group of longitudinal-cutter tools (15).

4. A method according to claim 1, wherein the external connecting cuts ($Q_1$, $Q_3$) are perpendicular to the conveying direction (3).

5. A method according to claim 1, wherein at least one of the further first longitudinal cuts ($L_{41}$, $L_{61}$) and at least one of the further second longitudinal cuts ($L_{42}$, $L_{62}$) lap over one another.

6. A method according to claim 1, wherein the internal connecting cut ($Q_2$) is perpendicular to the conveying direction (3).

7. A method of format change of a system for cutting a continuous web of corrugated board (2), which is conveyed in a conveying direction (3) and has two lateral margins (31, 32), into several continuous sectional webs of corrugated board ($B_1$, $B_2$, $B_3$, $B_4$), having a first and a second group of longitudinal-cutter tools (14, 15), the method comprising the following steps:

a. producing two first external longitudinal cuts ($L_{11}$, $L_{31}$) and an intermediate first internal longitudinal cut ($L_{21}$) in a web of corrugated board (2) by a first group of longitudinal-cutter tools (14);

b. disengaging at least a part of the first group of longitudinal-cutter tools (14) from the web of corrugated board (2);

c. engaging at least a part of the second group of longitudinal-cutter tools (15) with the web of corrugated board (2);

d. producing two second external longitudinal cuts ($L_{12}$, $L_{32}$) and an intermediate second internal longitudinal cut ($L_{22}$) in the web of corrugated board (2) by the second group of longitudinal-cutter tools (15);

e. producing an internal connecting cut ($Q_2$) which connects the first internal longitudinal cut ($L_{21}$) and the second internal longitudinal cut ($L_{22}$) and extends crosswise of the conveying direction (3);

f. producing two external connecting cuts ($Q_1$, $Q_3$) which extend crosswise of the conveying direction (3) and respectively connect a first external longitudinal cut ($L_{11}$, $L_{31}$) and a second external longitudinal cut ($L_{12}$, $L_{32}$);

g. wherein the longitudinal cuts ($L_{11}$, $L_{21}$, $L_{31}$, $L_{12}$, $L_{22}$, $L_{32}$) are made such that the first external longitudinal cuts ($L_{11}$, $L_{31}$) and the second external longitudinal cuts ($L_{12}$, $L_{32}$) lap over one another in pairs in the conveying direction (3) and such that the first internal longitudinal cut ($L_{21}$) and the second internal longitudinal cut ($L_{22}$) lap over one another in the conveying direction (3);

h. wherein the external connecting cuts ($Q_1$, $Q_3$) are applied such that they terminate before the lateral margins (31, 32);

i. wherein an area of overlap (U) is defined as the area between a first line that is located on the first internal longitudinal cut ($L_{21}$), and a second line that is located on the second internal longitudinal cut ($L_{22}$);

j. wherein further first longitudinal cuts ($L_{41}$, $L_{51}$, $L_{61}$) are produced by the first groups of longitudinal-cutter tools (14) and further second longitudinal cuts ($L_{42}$, $L_{52}$, $L_{62}$) are produced by the second group of longitudinal-cutter tools (15);

k. wherein each first longitudinal cut ($L_{51}$), which is located in the area of overlap (U), terminates before the termination of the first external longitudinal cuts ($L_{11}$, $L_{31}$) and the first internal longitudinal cut ($L_{21}$) and each second longitudinal cut ($L_{52}$), which is located in the area of overlap (U), starts after the beginning of the second external longitudinal cuts ($L_{12}$, $L_{32}$) and the second internal longitudinal cut ($L_{22}$); and l. wherein at least one of the further first longitudinal cuts ($L_{41}$, $L_{61}$) and at least one of the further second longitudinal cuts ($L_{42}$, $L_{62}$) lap over one another.

8. A method according to claim 7, wherein longitudinal cuts ($L_{51}$, $L_{52}$), which are located in the area of overlap (U), do not extend as far as to the internal connecting cut ($Q_2$).

9. A method according to claim 7, wherein, in the conveying direction (3), at least four first longitudinal cuts ($L_{11}$, $L_{21}$, $L_{31}$, $L_{41}$, $L_{61}$), which are produced by the first group of longitudinal-cutter tools (14), lap over at least four second longitudinal cuts ($L_{12}$, $L_{22}$, $L_{32}$, $L_{42}$, $L_{62}$), which are produced by the second group of longitudinal-cutter tools (15).

10. A method according to claim 7, wherein, in the conveying direction (3), at least five first longitudinal cuts ($L_{11}$, $L_{21}$, $L_{31}$, $L_{41}$, $L_{61}$), which are produced by the first group of longitudinal-cutter tools (14), lap over at least five second longitudinal cuts ($L_{12}$, $L_{22}$, $L_{32}$, $L_{42}$, $L_{62}$), which are produced by the second group of longitudinal-cutter tools (15).

11. A method according to claim 7, wherein the external connecting cuts ($Q_1$, $Q_3$) are perpendicular to the conveying direction (3).

12. A method according to claim 7, wherein the internal connecting cut ($Q_2$) is perpendicular to the conveying direction (3).

* * * * *